US006357200B1

(12) United States Patent
Vanderpan

(10) Patent No.: US 6,357,200 B1
(45) Date of Patent: Mar. 19, 2002

(54) DOOR FRAMING APPARATUS AND METHOD

(76) Inventor: Ronald D. Vanderpan, 1430 Glenmoor Way, San Jose, CA (US) 95129

( * ) Notice: Subject to any disclaimer, the term of this patent is extended or adjusted under 35 U.S.C. 154(b) by 0 days.

(21) Appl. No.: 09/519,085

(22) Filed: Mar. 6, 2000

(51) Int. Cl.[7] ..... E04G 23/00; E06B 1/56

(52) U.S. Cl. ..... 52/745.16; 52/215; 52/745.21; 403/265; 428/136; 428/343

(58) Field of Search ..... 52/745.15, 745.16, 52/213, 215, 217, 214, 204.55, 204.56, 745.21; 403/265; 428/131, 136, 137, 138, 304.4, 312.4, 317.1, 317.7, 343

(56) References Cited

U.S. PATENT DOCUMENTS 4,942,704 A * 7/1990 King ..... 52/171
5,565,254 A * 10/1996 Norvell ..... 428/136
5,863,471 A * 1/1999 Stanek ..... 428/136

FOREIGN PATENT DOCUMENTS

CA 568764 * 1/1959 ..... 52/396.03

* cited by examiner

*Primary Examiner*—Michael Safavi
(74) *Attorney, Agent, or Firm*—Gray Cary Ware & Freidenrich LLP

(57) ABSTRACT

A door framing apparatus and method wherein a pad member permits easy securing of the door and jamb to the king stud. The pad member maybe injected with an adhesive material to form a bond between the door/jamb assembly and the king stud. The pad member is formed of a compressible cellular foam material. A reservoir is formed within the pad to hold adhesive material which serves to attach the jamb to the king stud. A fill slot is provided in the pad to allow injection of the adhesive material into the reservoir. A channel is formed in the pad to allow the adhesive material within the reservoir to extend outside of the pad to form a bonding surface between the jamb and king stud. An adhesive layer is provided on a lateral edge of the pad member to allow initial attachment to either the jamb or king stud prior to installation of the door.

33 Claims, 7 Drawing Sheets

DOOR FRAMING APPARATUS AND METHOD

The present invention relates to an apparatus and method for the mounting of a door and in particular a pre-hung door and door jamb assembly in a door opening.

BACKGROUND OF THE INVENTION

Generally, in a large percentage of installed doors, whether residential or commercial, the doors are supplied to builders as pre-hung doorjamb assemblies. In particular, the door is already mounted or hung in the jamb assembly by fixing, on one side, a hinge, or an equivalent securing means, to one of the jamb members. The other side of the door is usually formed with a lockset and knob opening and an opposing jamb member is typically fixed with a latch or striker plate opening so that the door can be securely shut.

Typically, pre-hung door and jamb assemblies are shipped to the installation site with the jamb member opposite the door hinges either fastened directly to the edge of the door or spaced from the door edge by a plurality of shipping stabilizers. Often, the shipping stabilizers are nothing more than thin pieces of wood, paper or cardboard, that are nailed or adhesively secured between the door and jamb and held in place by strapping, for example, the entire door and jamb assembly with a cellophane material or the like or by nailing a nail through the jamb into the door. In other instances, an L-shaped stabilizing brackets have been provided that are bolted into the edge of the door and the front of the jamb. This stabilizing bracket and bolt system is more commonly used on commercial metal pre-hung doors by manufacturers such as Stanley Tools.

In most cases, when the door is received at the installation site, the jamb member opposite the hinges is freed or unfastened from the strapping or the nail is removed. Generally, all of the pieces attached to the door during shipping are removed.

While the door is hinged to one side of the jamb assembly, removal of the spacers and/or the unbinding of the assembly from the strapping frees the opposite doorjamb to move relative to the door. In assembling the door to the door frame of the home or building, the door needs to be positioned correctly in the door opening. Typically, the doorjamb is nailed into the king stud and the door is opened and closed to test the reveal space of the door. Typically, the measurement of the reveal space is done without the aid of a ruler. Any adjustment is then made to the reveal until the proper reveal space is achieved.

The shims used in the door are often made from wood or other similar material. While they are generally effective to provide the proper alignment for assembling the door in the door opening, conventional shims can only tolerate a limited pressure load or force before breaking for a given shim or shim assembly. That is, for a given shim, the average amount of pounds per square inch of force that each shim can tolerate is limited. The problem is that, as a general rule, the larger the force tolerance of the shims, the more secure the door installation since the door can withstand larger forces. Thus, it is desirable to provide a more secure door than is possible with typical shims. In addition, conventional shims are generally installed at the construction site when the door is being fitted into the opening. This adds time to the installation of the door in the frame since it is usually necessary to place a number of shims to properly align the door within the frame.

Moreover, the shims that are affixed to the door are usually thinner than the desired reveal space between the door and the jamb. The installer has to compensate by manipulating the jamb to produce the desired reveal space. Ideally, during this process, two installers work together to control the free or lockset side of the door. Typically, however, only one installer must attempt to hold the door while securing it to the king stud which results in a poorly aligned door. Using conventional techniques for installation, the door can be installed in approximately 20 to 30 minutes. This is a significant time savings over doors which are not pre-hung. However, it is still desirable to further reduce the time required to install pre-hung doors so that the construction of the building may occur more quickly and efficiently.

Further, the difficulties associated with manipulating the position of pre-hung door assemblies prior to installation can compromise the quality of the installation. Often, pre-hung doors are installed with varying degrees of skew, particularly when the door openings are roughly constructed. This is disadvantageous and can affect the stability and security of the installed doors. The poor installation of a door also affects the appearance of the door in that the reveal space may not be proper. In particular, the reveal space is 3/32" for an inside door and 1/8" for an outside door.

One apparatus developed to solve some of the above problems and limitations involves using a door framing device to space a pre-hung door mounted by hinged means to a jamb assembly during installation of the door and jamb assembly in a door opening. Conventional door framing devices include a spacer positioned between the door and the jamb assembly. The spacer has a thickness substantially equal to the desired reveal space to be maintained between door and the jamb assembly. The spacer is formed to secure the door to the jamb assembly and is formed to enable opening of the door after installation to allow removal of the spacer.

While such a door framing device indeed alleviates some of the disadvantages described above regarding conventional door installation, the device can be disadvantageous in that the spacer device is complicated to manufacture. In addition, because the opposing portions of the spacer device are separable, the device can often inadvertently separate, necessitating the use of a replacement device in order to properly install the door. This can add to the time required to install the pre-hung door in the door frame. In addition, if the installation is done improperly, it is very difficult to remove the door framing device since the door is installed using a plurality of nails.

Accordingly, it is desirable to provide a more robust spacer device that can be used during installation of a door in a frame and that is less likely to suffer from the disadvantages of conventional spacers. Moreover, it is desirable to provide a pad that has a characteristically stronger force tolerance than that of the prior art shims and that can be installed on the door assembly at the factory before the door is wrapped in the strapping. It is also desirable to provide a door frame assembly that can be installed easily by a single installer. It is to these ends that the present invention is directed.

SUMMARY OF THE INVENTION

The invention permits a door or other appliance in a residential or commercial building to be installed rapidly and properly. In particular, the system and devices in accordance with the invention permit a single installer to accurately install a pre-hung or other door. To accomplish this, one or more of the following: a spacer, a racking spacer, a positioning clip and a pad member, may be utilized. Each of these devices simplify the door installation process. For example, the pad members permits the door assembly to be quickly secured to the king stud. The other devices similarly make the installation process easier as described in more detail below. A bottom strap in accordance with the invention may permit the pre-hung or other door to be shipped while ensuring that the door remains closed during the shipping.

In accordance with the invention, a method for installing a door is described wherein a door and jamb assembly is positioned in a door opening and the door and jamb assembly includes one or more pad members attached to the outside of the jamb to abut the door opening. The method further comprises injecting a material into each pad member wherein each pad member comprises one or more channels to permit the material injected into the pad member to expand through the channels so that the injected material fills the pad member and expands out through the one or more channels in order to produce a bonding surface area between the jamb and the door opening so that the door and jamb assembly are installed within the door opening.

In accordance with another aspect of the invention, a pad for installing an item is provided wherein the pad comprises a compressible material having a central cavity and a filling slot, and one or more channels formed in the compressible material to permit material injected into the pad to expand outside of the pad to form a bonding surface area.

DETAILED DESCRIPTION OF THE PREFERRED EMBODIMENTS

The framing apparatus and method of the present invention are described in connection with their use in the installation of pre-hung doors. It should be understood that this description is for illustrative purposes and is not intended to be limiting since the apparatus and method may be used to install various items in a building, such as any door, any window or any vent, into any type of building.

Figure 1:
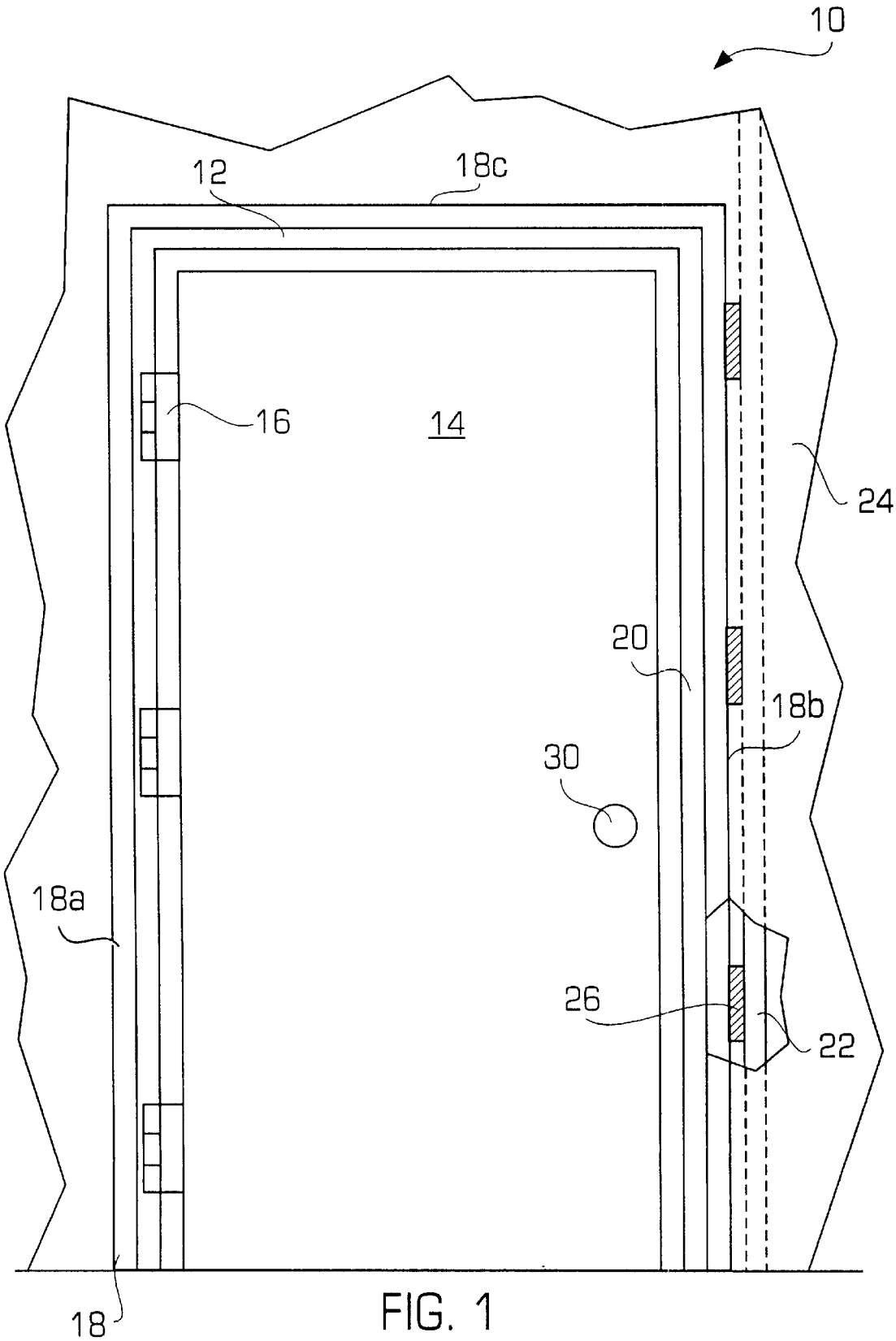
FIG. 1 is a front view, partially broken away, of a door assembly installed in a door opening using the door framing device and method of the present invention.

FIG. 1 illustrates a front view of a pre-hung door assembly 10 installed in a door opening 12 in a building. A door 14 may be mounted by one or more hinges 16 to a door jamb assembly 18 to form the pre-hung door assembly. The doorjamb assembly 18 includes first and second, substantially parallel, spaced apart vertically extending door jamb members 18*a,* 18*b* and a horizontally extending jamb rail member 18*c* that connects the first and second vertical door jamb members 18*a,*18*b*. The hinges 16 securely attach the door 14 to the first vertically extending door jamb member 18*a*. A small space 20 between the door 14 and the door jamb members 18*a–c* is referred to as a "reveal" space. The reveal space 20 functions as a tolerance for the door 14 so that the door 14 can freely open and close within the door jamb assembly 18. The reveal space 20 is typically small. For example on most residential doors, the reveal space 20 may be 3/32" for an inside door and 1/8" for an outside door, although smaller or larger reveal spaces are also used. For a pre-hung door, the door 14 and the jamb assembly 18 are delivered to the construction site pre-assembled so that the contractor may place the pre-hung door into a door opening 12 and secure it to install the door.

The door 14 and the jamb assembly 18 are shown in FIG. 1 installed in a door opening 12 that is usually defined by opposing structural framing members, such as two nailed together 2×4 studs, or king studs 22, to which a wall surface 24 can be mounted. In FIG. 1, only a single king stud on one side of the door is shown although there may be a king stud located on each side of the door opening 12. A plurality of spacer pads 26 may be positioned between the king studs 22 and the jamb assembly 18 that are used to adjust the position (e.g., true-up or plumb) of the pre-hung door assembly 10 (e.g., the door 14 and jamb assembly 18) in the door opening 12. Unlike conventional door frame assemblies that require the jamb members 18*a–c* to be secured by fasteners, such as nails, to the king studs 22 to hold the door 14 squarely in place in the opening 12, the pad members 26 in accordance with the invention in combination with an injected adhesive material form a bond that is sufficient to hold the door 14 squarely in place in the opening 12 as described in more detail below. In fact, a door installed using the pads 26 and the adhesive material in accordance with the invention is capable of withstanding a much larger force tolerance than that of doors installed using conventional methods, such as by securing the jamb members 18*a–c* to the king studs 22 with nails. The pads 26 and adhesive also make the removal of the pre-hung door easy in the event that the door was improperly installed. Now, a pre-hung door assembly 10 in accordance with the invention prior to installation into a door opening will be described.

Figure 2:
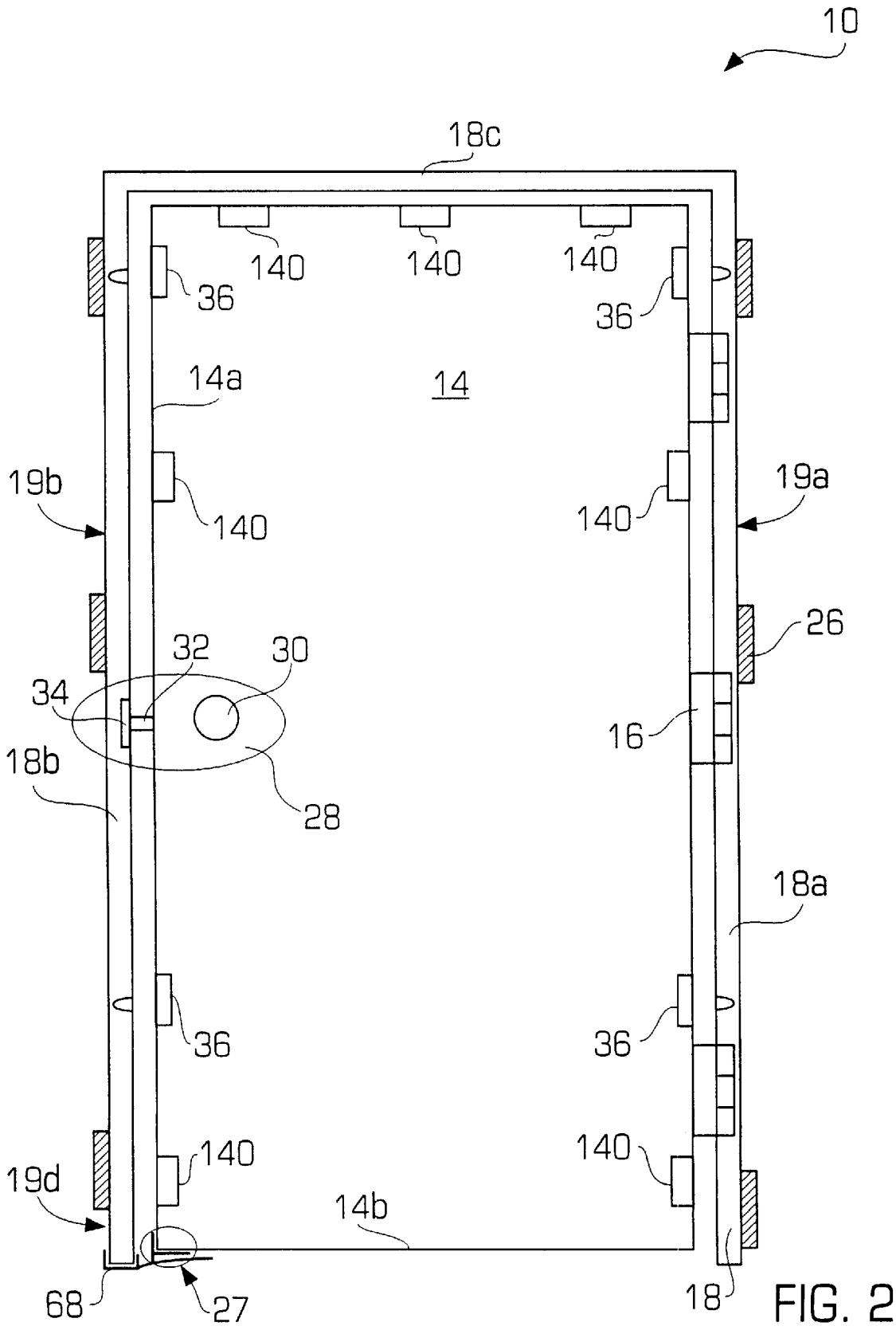
FIG. 2 is a front view of a door assembly including pads in accordance with the invention that may be completed at a factory.

FIG. 2 shows a front view of a pre-hung door assembly 10 that includes the pads 26 in accordance with the invention.

The pre-hung door assembly 10 includes a door 14, the hinge members 16 that mount the door 14 to the jamb assembly 18 and a plurality of pads 26 disposed about predetermined areas of the respective outer surfaces 19*a,* 19*b* of the first and second vertically extending doorjamb members 18*a,* 18*b*. In particular, the pads 26 may be placed at periodic intervals so that the weight of the door assembly is distributed between the pads 26 as described below. A side 14*a* of the door 14 opposite the hinged members 16 is formed with a lockset and knob opening 28 into which a doorknob 30 and locking mechanism 32 are positioned. A latch or striker plate opening 34 is formed in the vertical jamb member 18*b* adjacent the side 14*a* of the door so that the door 14 can be securely shut.

A plurality of spacers 140 are located at various locations around the door to maintain the reveal space between the door and the jamb. The spacer 140 may have a width of 3/32" or 1/8" depending on the desired reveal space. The spacers 140 may be affixed to the door assembly 10 before the pre-hung door assembly 10 is strapped and shipped to the construction site. The positioner clips 36, which will be described in more detail below, are affixed to the jamb members 18 and cooperate to align the door 14 with the jamb member 18 during shipping and installation. Preferably, the positioner clips 36 may be affixed to the jamb members 18 using a nail, glue or other equivalent securing means. These positioner clips 36 provide many advantages over conventional spacers, such as that shown in FIG. 3.

A racking spacer 27 may be located at the end of the door adjacent the hinges 16 and may be attached to the jamb assembly 18. The racking spacer 27 may hold the door 14 a predetermined distance above the ground in order to ensure a proper reveal space as described below with reference to FIG. 7.

A bottom strap 68, which will be described in more detail below, may be affixed to the bottom edge 14*b* of the door 14, during the shipping of the door between the factory and the installation site, and releasably secures the door 14 to the vertically extending jamb member 18*b* to hold the non-hinged side secure against the jamb member 18*b* during shipping. Once the door arrives at the installation site, the bottom strap 68 may be removed and discarded.

Before the door assembly 10 is strapped for shipping by, for example, wrapping the door assembly 10 with a cellophane material or the like, a plurality of shipping stabilizers (not shown) may be affixed to the door assembly 10. The shipping stabilizers ensure that the door assembly 10 remain fixed during transportation to the installation site. Advantageously, a door assembly 10 in accordance with the invention can be simply shoved into a door frame 12 and be installed within a short period of time, versus the more complicated and often frustrating installation of conventional door assemblies. Now, each of the pieces described above will be described in more detail. First, to better understand the spacer 36 in accordance with the invention, a conventional spacer will now be described.

Figure 3:
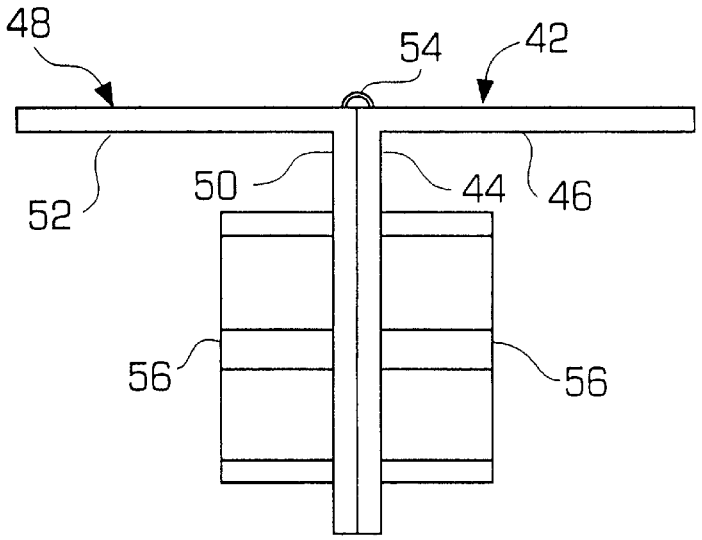
FIG. 3 PRIOR ART
FIG. 3 is a side view of a conventional spacer.

FIG. 3 illustrates a conventional spacer clip 40 that typically includes a door portion 42 that has an L-shaped door element having one leg 44 that extends between the door 14 and the door jamb 18 and another leg 46 that extends along a front surface of the door 14. Similarly, the conventional spacer clip 40 includes a jamb portion 48 that has an L-shaped jamb element having one leg 50 that extends between the door 14 and the doorjamb 18 and a second leg 52 that extends transversely along the front surface of the jamb member 18. The door element 42 and jamb element 48 are coupled together via a connecting portion 54 that permits the door element and the jamb element to be separated, parted or severed. These spacer clips 40 also include a lockset bore interfacing element 56 that engages the lockset bore portion of the door 14 or jamb 18. Thus, such a spacer clip 40 is generally only usable with portions of the door 14 or jamb 18 that include a lockset bore hole. It is therefore desirable to provide a spacer that can be used at any location on the door assembly 10 and that is simple to fasten to the jamb member 18 and to remove after installation of the door assembly 10 in the door frame 12. Now, the spacer clip 36 in accordance with the invention will be described in more detail.

Figure 4:
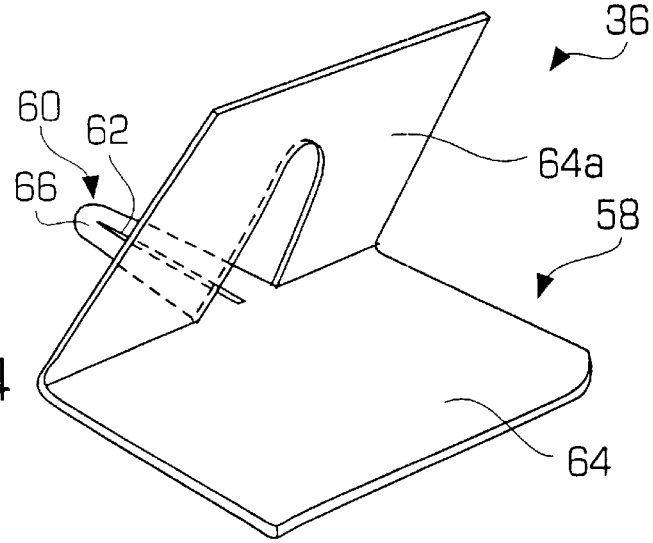
FIG. 4 is an isometric view of an embodiment of a position clip in accordance with the invention shown in FIG. 2.
Figure 5:
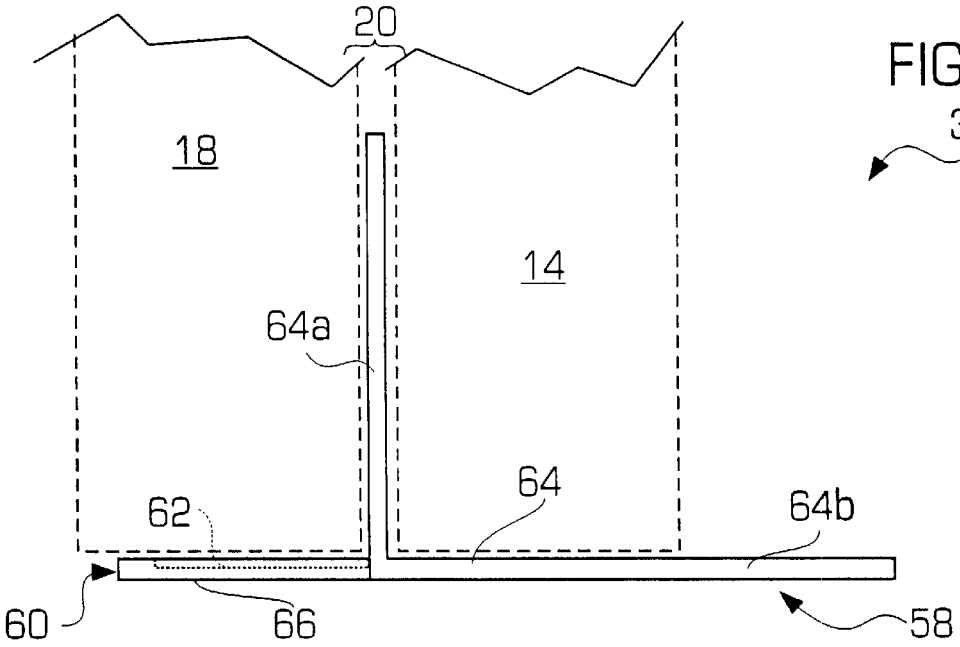
FIG. 5 is a side view of the spacer shown in FIG. 4.

FIGS. 4 and 5 are isometric and side views, respectively, of an embodiment of the positioner clip 36 in accordance with the invention, in which like elements are identified by like reference numbers. The positioner clip 36 may be used to position the door properly in the rough opening (e.g, so that the front of the door is properly positioned with respect to the front of the rough opening. The positioner clip 36 may also be used as a spacer between the door and the jamb to maintain the reveal space between the door and jamb. In accordance with the invention, the positioner clip 36 may comprise a door portion 58 and a jamb member portion 60. The jamb member portion 60 may include a slot 62 therein for adjustably coupling/attaching the jamb member portion 60 to the jamb member 18, using for example a screw or other equivalent fastening means, when the door and the jamb are aligned with the desired reveal space therebetween.

The door portion 58 may include an L-shaped member 64 that is configured to abut an edge 14*a* of the door 14 (See FIG. 2). A reveal leg 64*a* of the L-shaped member 64 extends between the door 14 and the jamb member 18 so as to be disposed in the reveal area 20 (See FIG. 5). The thickness of the reveal leg 64*a* may preferably be substantially equivalent to the desired reveal space 20. The jamb member portion 60 includes an opposing member 66 aligned with a leg 64*b* of the L-shaped member 64. The opposing member is configured to abut the jamb member 18. The slot 62 in the opposing member 66 permits the jamb member portion 60 to be fixed and held secure to the jamb member 18, for example using a nail or other fastening means. As shown, the door portion 58 and the jamb member portion 60 of the spacer 36 are a single piece so that the positioner clip 36 can be simply removed after installation of the door without requiring any separation of the door portion 58 or the jamb member portion 60. In an embodiment, the opposing member 66 may be formed by cutting out a section of the L-shaped member 64 as shown in FIG. 4. In a preferred embodiment in which the spacer clip may be formed by a molding process, the opposing member 66 may be molded and there may be no cut out portion of the L-shaped member. Now, more details of the bottom strap will be described.

Figure 6:
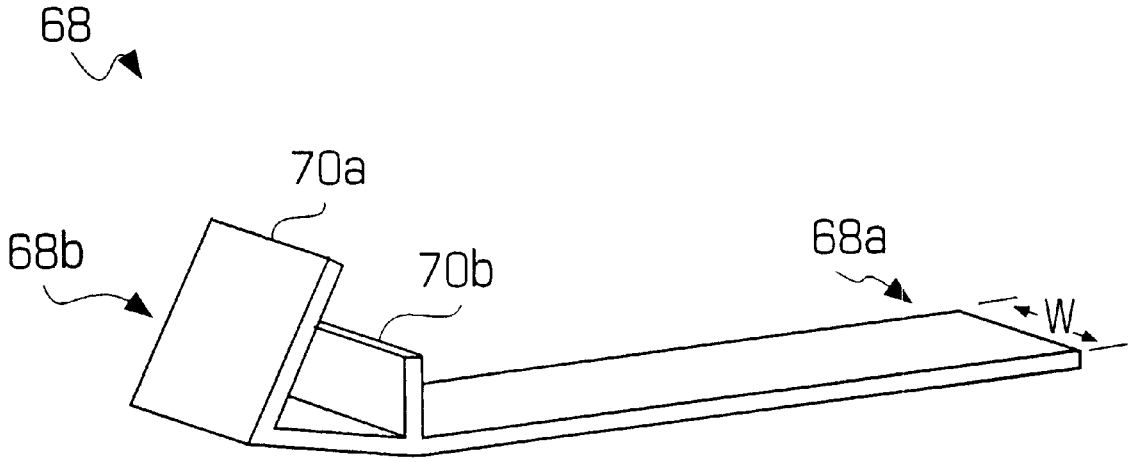
FIG. 6 is an isometric view of an embodiment of the bottom strap shown in FIG. 2 that couples the door to the jamb member during shipping.

FIG. 6 is an isometric view of an embodiment of the bottom strap 68 shown in FIG. 2 that releasably attaches the door 14 to the jamb member 18*b* as shown in FIG. 2 during shipping. The bottom strap 68 may be made of a flexible resilient material, such as a plastic material. Preferably, the strap 68 may be made of ABS. The strap 68 may include a flat portion 68*a* that may preferably have a width, w, as shown in FIG. 6, that is substantially equivalent to the width of the bottom edge 14*a* of the door 14 (See FIGS. 1 and 2) so that the bottom strap 68 may be affixed to the bottom edge 14*a* of the door 14 using, for example, a staple or other equivalent fixing means.

The strap 68 may also include a second portion 68*b* with first and second substantially vertically extending members

70*a,* 70*b* disposed from each other at a distance substantially equivalent to the thickness of the jamb member 14*b* so that the second portion 68*b* of the bottom strap 68 can hold a bottom end 19*d* of the jamb member 18*b* as shown in FIG. 2. When the bottom strap 68 is affixed to the door 14 and the bottom end 19*d* of the jamb member 18*b,* the door 14 and jamb member 18*b* are held in a secure relationship so that the free rotation of the jamb member 18*b* is eliminated and the door 14 can be shipped. In other words, the bottom strap 68 maintains the door 14 and the free-swinging jamb member 18*b* in a united relationship so that when the strapping is removed from the door assembly 10, the jamb member 18*b* does not swing freely and is instead held fast against the door 14. Therefore, the door 14 is much easier to ship. After shipping, the bottom strap 68 can be removed from the door assembly 10, for example, by striking the bottom strap 68 with one's foot or otherwise applying a lateral force to the bottom strap 68 to dislodge the fixing means. Now, the racking spacer 27 in accordance with the invention will be described in more detail.

Figure 7:
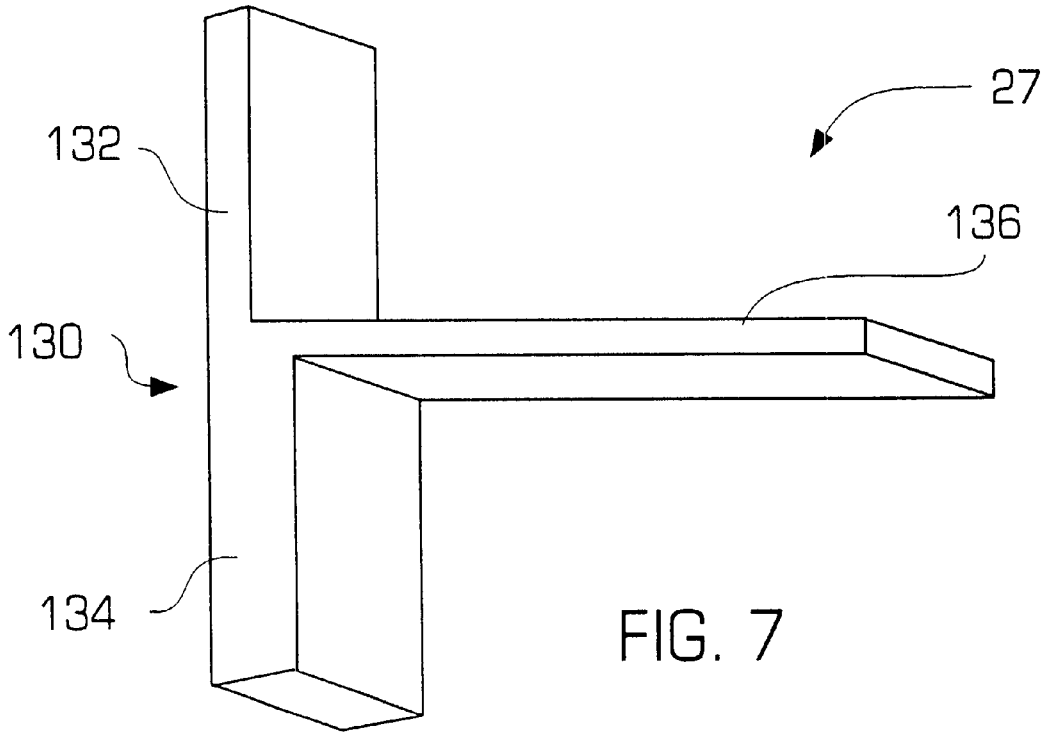
FIG. 7 is a perspective view illustrating a racking spacer in accordance with the invention.

FIG. 7 is a perspective view of the racking spacer 27 in accordance with the invention. The racking spacer 27 may include a first member 130 having a first portion 132 and a second portion 134. The first portion 132 may have a width equal to the desired reveal space of the particular door assembly. The racking spacer 27 may also include a tongue portion 136 extending substantially horizontally from the first member 130 and substantially parallel to the ground. The tongue portion 136 may support the door a predetermined distance off of the ground. In accordance with the invention, the width of the first portion 132 may be adjusted depending on the desired reveal space for a particular door. Now, the pads 26 in accordance with the invention will be described in more detail.

Figure 8:
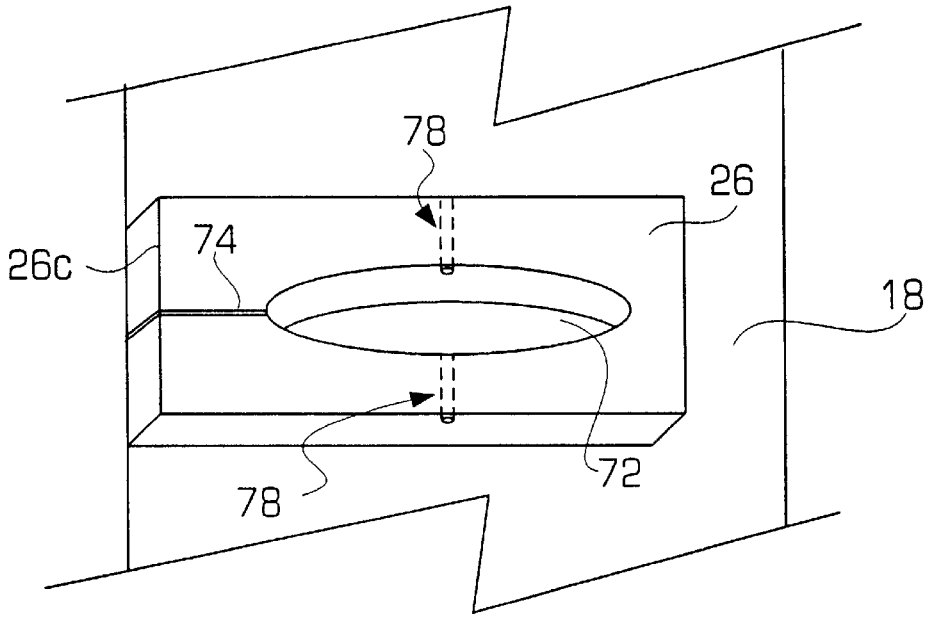
FIG. 8 is a side view of the door assembly shown in FIG. 2 illustrating an embodiment of the pad in accordance with the invention.
Figure 9:
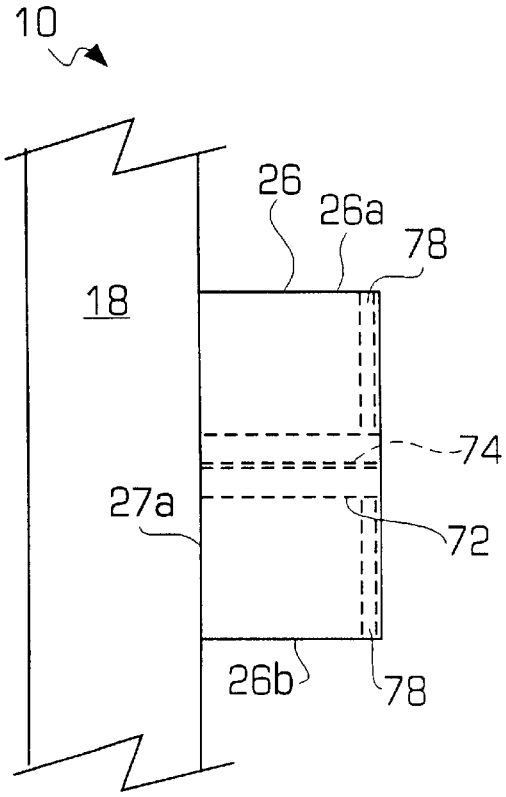
FIG. 9 is a front view of the door assembly shown in FIG. 2 illustrating an embodiment of the pad in accordance with the invention.

FIGS. 8 and 9 are side and front views, respectively, of a portion of the door assembly 10 shown in FIG. 2 and in particular the jamb 18 illustrating an embodiment of the pad 26 in accordance with the invention in which like elements are identified by like reference numbers. As described above, the door assembly 10 includes one or more pads 26 spaced around the door 14. In the figures, the king stud 22 normally a buffing the other edge of the pad has been removed in order to better illustrate the structure of the pad 26.

The pad member 26 can be affixed to the door assembly 10 at the factory, as was described above, or it can be affixed to the door assembly 10 or king stud 22 at the construction site prior to installation of the door assembly 10. The pad member 26 is preferably made of a compressible cellular foam material. It should be noted, however, that any opencelled foam material can be used that may be compressed as needed. As will be described below, an opencelled material is desirable because it allows for an adhesive material to permeate the foam providing a more secure bond and allows for compression of the pad 26 so that it may be fit in the reveal space between the jamb member 18 and the king stud 22 during installation of the door assembly 10. Thus, a single pad member may be used for different spaces since it can be compressed somewhat. In addition, if the space between the jamb member 18 and the king stud 22 is wider than a single pad member, one or more pad members may be stacked on top of each other to fill the space. A surface 27*a* of the pad member 26 may be covered with any typical adhesive so that the pad member 26 can be secured/adhered to either the jamb member 18 or to the king stud 22 prior to the installation of the door assembly 10.

The pad member 26 may also include a cavity 72 disposed substantially in the middle of the pad member between the edges 26*a,* 26*b* of the pad member 26. Preferably, the cavity 72 extends vertically through the entire thickness of the pad member 26. However, in accordance with the invention, the cavity may also extend only partially through the thickness of the pad 26. As shown in FIG. 8, the cavity 72 may preferably be oval shaped, but it may also be any other shape, such as a circle, a rectangle, a square, etc. A side 26*c* of the pad 26 may has a fill slot 74 cut therein that extends from the outer edge of the side 26*c* to the cavity 72. In a preferred embodiment, the fill slot 74 may extend through the pad material to form a channel between the two pieces of the pad member. However, in accordance with the invention, the fill slot 74 may also not extend through the pad member and may therefore form a feed hole that extends from the side of the pad member and connects to the cavity 72. This fill slot 74 allows for an adhesive material as described below to be injected, or other inserted, into the cavity 72 of the pad 26 when the door 14 is installed. The combination of the adhesive material in the cavity of the pad member and the pad member form a bond between the jamb member 18 and the king stud 22 that secures the jamb member to the king stud as would typically be done with nails.

Figure 11:
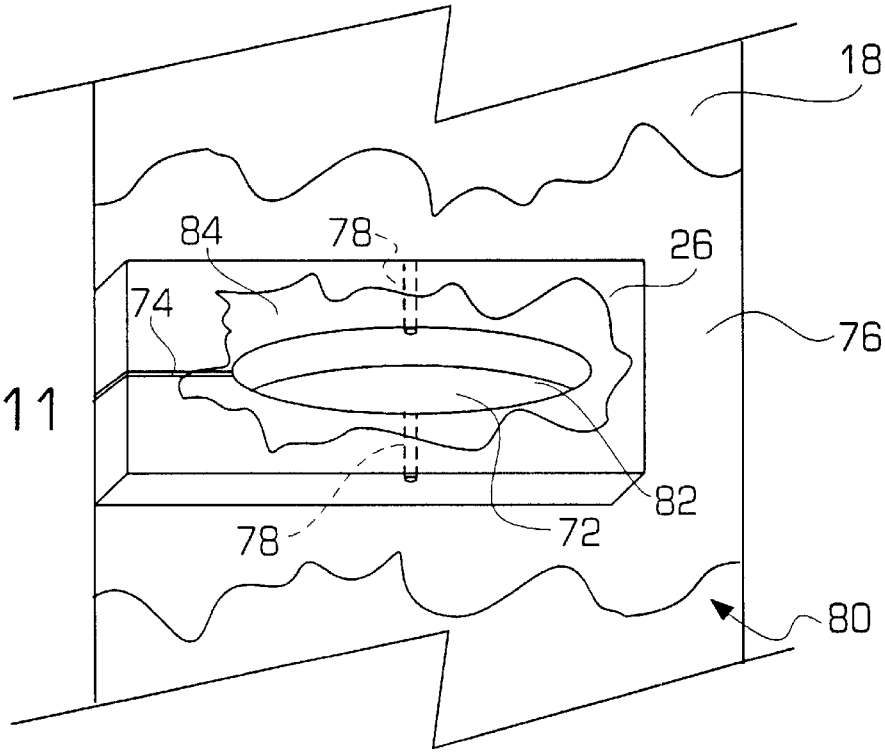
FIG. 11 is a side view of FIG. 9 without the king stud to illustrate the spread surface area of the adhesive material that forms a secure bond between the jamb member and the king stud in accordance with the invention.
Figure 12:
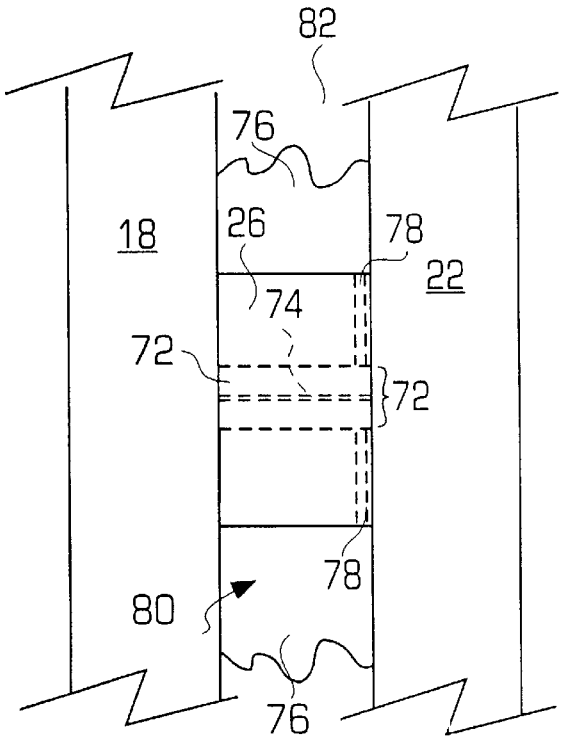
FIG. 12 is a front view of FIG. 10 showing the spread area of the adhesive material that has been injected into the pad member.

The pad member 26 may also include one or more channels 78 that extends from the cavity 72 through pad member 26 to an outer surface of the lateral edges 26*a,* 26*b*. In a preferred embodiment, there may be two channels on opposite sides of the pad member and the channels may be hollow tube-like channels formed near the surface of the pad member as shown in FIGS. 8 and 9. For example, the channels 78 may be formed by typical tubes attached to the pad member. However, in accordance with the invention, the channels 78 may also be troughs formed in the pad member, hollow channels formed near the center of the pad member or another other type of structure that permits the adhesive material fed into the cavity 72 to move through the channel. In particular, the channel 78 operates as a flowguide or blowhole for adhesive material 76 (as shown in FIGS. 11 and 12) that is injected, or otherwise inserted into the cavity 72 so that the adhesive material 76 can be directed to respective areas 80 of the jamb member 18 and king stud 22 (See FIG. 11 and 12) to harden and form a bond between the jamb member 18 and the king stud 22. When multiple pad members are positioned at various points around the prehung door assembly, the bonds formed by the pad members in combination with the adhesive material secures the door to the king stud. By directing the adhesive material 76 to these areas 80, a large bond surface area can be established thereby resulting in an increased bond strength between the jamb member 18 and the king stud 22. It should be noted that while the channels 78 are shown in FIG. 8 as cylindrical channels 78, they can be of any geometric shape. Further, any number of channels 78 can be provided, depending on the desired bond surface area. Moreover, the cavity 72 and pad member 26 can be of any geometric shape, depending on the orientation of the king stud 22 or jamb member 18. Preferably, however, the length of the pad member 26 is slightly narrower than the width of the king stud 22 and jamb member 18 so that a tolerance can be provided. Now, a king stud 22 and a jamb assembly 18 with a pad member 26 between them will be described.

Figure 10:
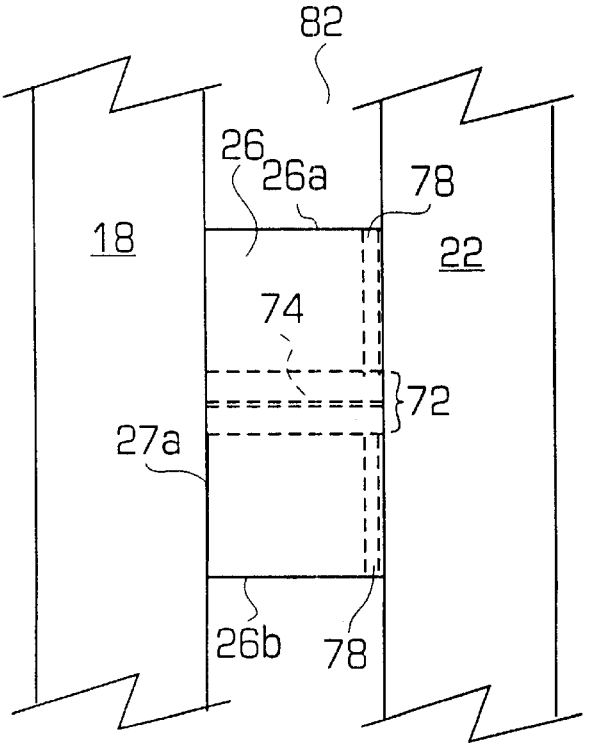
FIG. 10 is a front view of part of the structure shown in FIG. 1 illustrating the disposition of the pad between the jamb member and the king stud.

FIG. 10 is a front view of a pad member 26 in accordance with the invention disposed between the king stud 22 and doorjamb member 18. As described above, the pad member 26 provides a conduit for injecting material to secure the door assembly to the king stud and centers the door in the door opening. As shown, the pad 26 is compressibly disposed in a gap portion 82 between the jamb member 18 and the king stud 22 such that the pad member fills the space as shown. To accomplish this, the pad 26 (either compressed or uncompressed) may be of a thickness substantially equivalent to the thickness of this gap portion 82 so that the door assembly may be installed into the door opening by simply pushing the door assembly into the opening 12 thereby compressing the pad member as necessary so that a tight fit results. If the gap 82 is wider than a single uncompressed pad member, then multiple pad members may be stacked on top of each other. Further, the pad members 26 assist in squaring-up the door assembly 10 so that it is aligned within the door opening 12 (See FIGS. 1 and 2).

Once the door assembly 10 has been positioned within the door opening 12, in accordance with the invention, using the pad members 26, the adhesive material 76 may be injected, or otherwise inserted into the cavity 72 portion of the pad members 26 in order to form a secure bond between the jamb member 18 and the king stud 22. In a preferred embodiment, an adhesive injection gun may be used to inject the adhesive material 76 into the cavity 72. The fill slot 74 may receive a nozzle or other tip end of the injection gun so that the material can be injected into the cavity 72. The adhesive material 76 may be a hot melt glue that has a high rubber content, such as that manufactured by 3M and Norton or it may preferably be a polyurethane foam, such as that available from Convenient Products. In accordance with the invention, other adhesive materials may also be used without departing from the invention.

Advantageously, in a preferred embodiment using the foam, the foam may characteristically expand when exposed to air. Thus, the foam can expand, for example, by a 30:1 ratio when it comes into contact with air so that only a very small amount of foam needs to be used in order to fill the cavity 72 and expand out of the channels 78. Depending on the desired bond surface area, the foam injection time could be less than one second. Because the foam expands as it comes into contact with the air, it can be directed, via the channels 78, to areas 80 along the jamb member 18 as shown in FIGS. 11 and 12. The diversion of the foam up and down the jamb member 18 to establish a large bond surface area is advantageous because the foam provides an extremely strong bond capable of withstanding a significant force load once the foam expands and solidifies. For example, each pad member has a bond surface area of about 18 to 20 square inches so that six pads (a typical number used for a door installation) may have up to 120 square inches of bond surface area that is capable of tolerating a force load of approximately 3,000 pounds. Of course, depending upon the type of adhesive material 76 used to establish the bond between the jamb member 18 and the king stud 22, the tolerance may be higher or lower. For example, if a hot melt adhesive is used, a smaller bond area is required to achieve the same tolerance. Now, the pad member with the foam injected into the pad will be described in more detail.

FIGS. 11 and 12 are front and side views, respectively, of the structure shown in FIG. 10, in which like elements are identified with like reference numbers. In Figure 11, the structure is shown with the king stud 22 removed to illustrate the spread bonding area of the adhesive material 76. As shown in FIGS. 11 and 12, the adhesive material 76 is directed from the cavity 72, via the channels 78, to areas 80 above and below the pad member on the jamb member 18. This bonding area spread can be controlled depending on the length of injection time and the amount of adhesive material 76 injected into the cavity 72. Additionally, the adhesive material 76 also expands within the cavity 72 so as to form a primary bond area 82 between the jamb member 18 and the king stud 22 in the vicinity of the cavity 72. Moreover, the adhesive material 76 may also saturates the porous, open cellular material of the pad member 26 and expands to form a secondary bond area 84 between the jamb member 18 and the king stud 22 about the periphery of the cavity 72. Again, depending on the injection time, the amount of adhesive injected into the cavity and the expansion coefficient of the adhesive material 76, the saturation into the open-cellular material of the pad member 26 can be controlled. Thus, by injecting the adhesive material 76 into the cavity 72 and by directing the material to areas 80 of the jamb member 18 using the channels, a secure bond can be established between the jamb member 18 and the king stud 22 that is capable of withstanding force loads substantially greater than that of conventional assemblies.

Advantageously, while the pad members 26 and adhesive material 76 together cooperate to form this secure bond between the jamb member 18 and the king stud 22, the adhesive material 76 and pad member 26 are easily removable. In fact, by sliding, for example, the edge of a knife, between the jamb member 18 and the pad member 26 with the adhesive material 76 bond, in a rapid fashion, the pad member 26 and the adhesive material 76 separate from the jamb member 18 and another pad member 26 can be substituted so that the bonding can be performed again. Thus, a mistake in installation may be easily corrected. A diagram showing stacked pad members will now be described.

Figure 13:
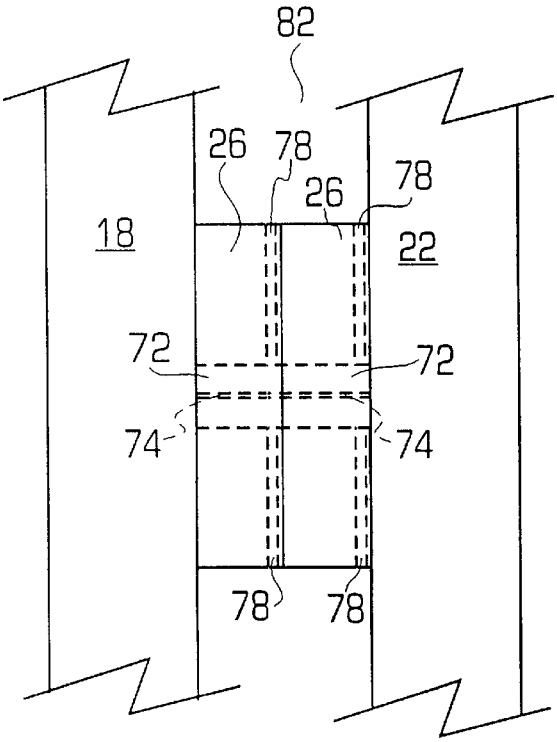
FIG. 13 is a front view of an alternative embodiment of the invention showing adjacent pads stacked to form a tight tolerance between the jamb member and the king stud.

Often, the space 82 between the king stud 22 and the jamb member 18 is larger than the thickness of the pad member 26. In such a situation, a single pad member 26 may not be sufficient to provide a satisfactory filling of the space between the jamb member 18 and the king stud 22 when the door assembly 10 is installed in the door frame 12. In accordance with the invention, the pad members 26 may be stacked, such as is shown in FIG. 13, resulting in a pad of a thickness appropriate to provide a satisfactory filling up of the space between the jamb member 18 and the king stud 22. Depending on the number of stacked pad members 26, the injection time and amount of adhesive material 76 to be injected into the cavities 72 may need to be adjusted accordingly in order to establish a sufficient surface area spread of the adhesive material 76 and create a secure bond between the jamb member 18 and the king stud 22. Now, a method for preparing a door in accordance with the invention for installation will be described.

Figure 14:
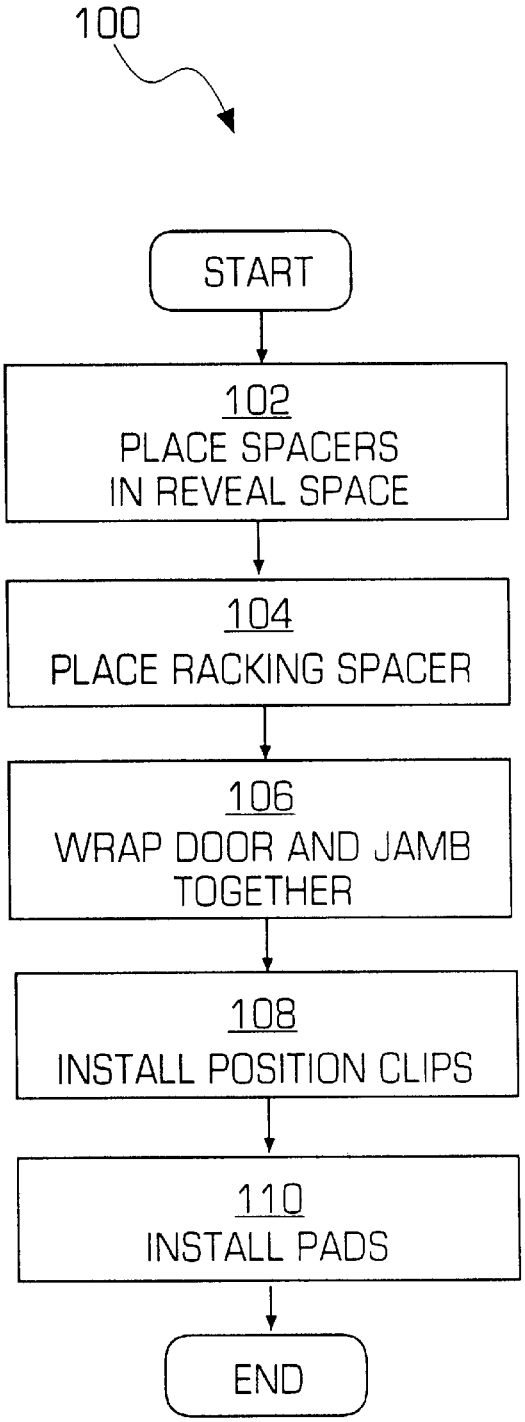
FIG. 14 is a flowchart illustrating a method for assembling a door in accordance with the present invention.

FIG. 14 is a flowchart illustrating a method 100 for preparing a door for installation in accordance with the invention. In step 102, the pre-hung door with the door and door jamb assembly is obtained and one or more spacers (as shown in FIGS. 4 and 5) are placed in the reveal space. For a typical door, the spacers may be positioned at the very top, in the middle and 10 inches from the bottom of the side of the door with the hinges. Additional spacers may be placed at the top of the door and at the very top, at the striker plate and 10 inches from the bottom of the side of the door with the latch plate. There spacers ensure that the proper reveal space is maintained. In step 104, a racking spacer (shown in FIG. 2) is attached to the jamb that positions the door a predetermined distance off of the ground. The bottom strap may ensure that the door does not swing open during shipping to the installation site. In step 106, the door and jamb are wrapped with a stretch tape. In a preferred embodiment, the tape may be wrapped at the very top and cover the spacers to keep the spacers from falling out of the door. The wrap may also be applied 10 or so inches from the bottom of the door and cover the spacer as well.

In step 108, the position clips are installed using the wrapping as a guide. To install the position clips, another layer of tape is placed on the door and the clips are pushed through the tape. Finally, in step 110, the pad members are installed so that the fill slots are facing the appropriate direction for easy filling. The pads may be installed by removing the adhesive strip and pressing the pad against the door jamb assembly. The pads may be installed below the shrink wrap at the top of the door, in the middle of each side of the door and 5 inches from the bottom of the door on each side. The door/jamb assembly is now ready to be installed into the door opening by a single installer as described above. Now, a method of installation in accordance with the invention will be described.

Figure 15:
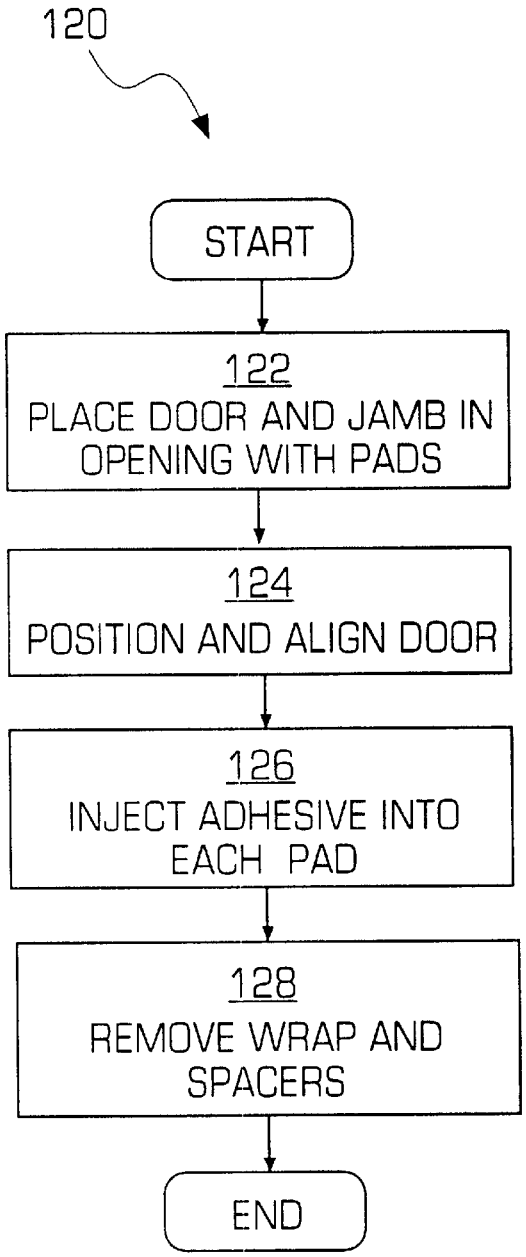
FIG. 15 is a flowchart illustrating a method for hanging and securing a door within a door frame in accordance with the invention

FIG. 15 is a method 120 for installing and securing a pre-hung door in accordance with the invention. As described above, the pre-hung door in accordance with the invention may be installed by a single person. In step 122, the pre-hung door still wrapped from the factory may be placed into the door opening with the pads already installed. If the pads are not installed, then the installed may secure the pads to the appropriate locations to form the bonding areas on the door. Once the door is placed into the opening and aligned properly (including positioning the door so that the pointed side of the position clips are flush with the sheet rock or finished wall) in step 124, the installer may inject the adhesive material into the fill slots of each pad. In accordance with the invention, once the installer sees the adhesive material come out of the channels in the pad, the injection of the adhesive material for that pad is complete. After the adhesive material has cured and solidified (typically 5 minutes for the polyurethane foam in the preferred embodiment), the wrapping on the door and the spacers may be removed in step 128 and the door has been installed and secured very rapidly.

While the foregoing has been with reference to a particular embodiment of the invention, it will be appreciated by those skilled in the art that changes in this embodiment may be made without departing from the principles and spirit of the invention, the scope of which is defined by the appended claims.

What is claimed is:

1. A method for installing a pre-hung door into a door opening, said method comprising:

positioning a door jamb assembly, including a door and a horizontally extending door jamb member connecting two parallel, vertically extending door jamb members in a door opening;

attachably connecting a pad member to the lateral edge of the jamb to abut the door; and injecting a material into said pad member, wherein said pad member includes one or more channels to permit said material to expand through said channel thereby producing a bonding surface area between the jamb assembly and within the door opening.

2. The method of claim 1, wherein said positioning step further comprises maintaining a space between said door jamb assembly and said door opening.

3. The method of claim 2, wherein said positioning step further comprises placing, at different intervals, one or more pads at the lateral edge of said jamb so that the weight of the door jamb assembly is distributed between said pads.

4. The method of claim 3, wherein said positioning step further comprises placing a spacer on a lateral edge of the door to align said door with said door jamb assembly.

5. The method of claim 1, wherein said injecting step further comprises injecting the material into the pad member so that said material permeates said pad member thereby providing a more secure bond.

6. The method of claim 5, wherein said injecting step further comprises injecting the material into the pad member thereby pushing said material through said channel to a lateral edge of said pad member.

7. The method of claim 6, wherein said injecting step further comprises injecting said material into a cavity located within said pad member with an injection gun.

8. The method of claim 4, wherein said positioning step further comprises placing a spacer within the space between the door jamb assembly and the door opening.

9. The method of claim 8, wherein said positioning step further comprises placing at least one spacer at the top edge of said door.

10. The method of claim 9, wherein said positioning step further comprises placing at least one spacer at the bottom edge of said door.

11. The method of claim 10, wherein said positioning step further comprises placing at least one spacer at the lateral edge of said door.

12. The method of claim 11, wherein said positioning step further comprises placing at least one spacer on a strike plate attachably connected to said door.

13. A pad for attaching a first member to a second member comprising:

a compressible material having a reservoir for containing material;

a fill slot formed in the compressible material wherein a material can be injected into said reservoir;

a channel formed in the compressible material to permit the material injected into the reservoir to extend outside said pad to form a bonding surface between the first member and the second member; and an adhesive layer attachably connected to at least one lateral edge of said pad.

14. The pad of claim 13, wherein the channel extends from said reservoir through said pad to an outer surface of a lateral edge of the pad.

15. The pad of claim 14 further comprising a second channel that extends from the opposite side of said reservoir through said pad to the outer surface of a second lateral edge of the pad opposite the lateral edge.

16. The pad of claim 13, wherein the material injected into the pad is an adhesive material that bonds the first and second member together.

17. The pad of claim 16, wherein said adhesive material injected into the pad permeates said compressible material and hardens the compressible material to provide a larger bonding surface between the first and second member.

18. The pad of claim 13, wherein the reservoir is centrally located.

19. The pad of claim 18, wherein said reservoir extends through the entire thickness of said pad so that the injected material touches and bonds to the first and second member.

20. The pad of claim 18, wherein said reservoir extends partially through the thickness of said pad.

21. The pad of claim 15, wherein the reservoir is centrally located and wherein said channels extend from the centrally located reservoir to an outer surface of one or more lateral edges of the pad.

22. The pad of claim 13, wherein the reservoir is oval-shaped.

23. The pad of claim 13, wherein the fill slot extends from lateral edge of said pad to the reservoir.

24. The pad of claim 23, wherein the fill slot extends through said pad thereby forming a channel.

25. The pad of claim 23, wherein the fill slot forms a feed hole that extends from a lateral edge of the pad to the reservoir.

26. The pad of claim 13, wherein the compressible material is composed of a compressible cellular foam material.

27. The pad of claim 13, wherein said channel is cylindrically-shaped.

28. The pad of claim 16, wherein said adhesive material has a high rubber content.

29. The pad of claim 16, wherein said adhesive material is a polyurethane foam.

30. The pad of claim 16, wherein said adhesive material expands when exposed to air.

31. The pad of claim 16, wherein said adhesive material expands within said reservoir so as to form a bonding area between said first member and the second member.

32. The pad of claim 16, wherein said adhesive material saturates the edge of said reservoir thereby forming a bonding area between said first member and a second member.

33. The pad of claim 13, wherein the first member comprises a door jamb and said second member comprises a king stud.

* * * * *